US008534864B2

(12) United States Patent
Forteza et al.

(10) Patent No.: US 8,534,864 B2
(45) Date of Patent: Sep. 17, 2013

(54) MOUNTING RAIL FOR A LAMP

(75) Inventors: Gabriela Vidal Forteza, Palma de Mallorca (ES); Michael Kramer, Kamp-Lintfort (DE)

(73) Assignee: LED-LINEAR GmbH, Neukirchen-Vluyn (DE)

( * ) Notice: Subject to any disclaimer, the term of this patent is extended or adjusted under 35 U.S.C. 154(b) by 140 days.

(21) Appl. No.: 13/307,174

(22) Filed: Nov. 30, 2011

(65) Prior Publication Data

US 2013/0039052 A1 Feb. 14, 2013

(30) Foreign Application Priority Data

Aug. 12, 2011 (DE) ..... 20 2011 104 303 U

(51) Int. Cl.
*F21S 4/00* (2006.01)

(52) U.S. Cl.
USPC ..... 362/223; 362/647; 362/249.03

(58) Field of Classification Search
USPC ..... 362/147, 219, 223, 217.14, 647, 362/249.03
See application file for complete search history.

(56) References Cited

U.S. PATENT DOCUMENTS 6,065,849 A * 5/2000 Chen ..... 362/101
6,220,721 B1 * 4/2001 Chan et al. ..... 362/219
7,600,907 B2 * 10/2009 Liu et al. ..... 362/555

* cited by examiner

*Primary Examiner* — David V Bruce
(74) *Attorney, Agent, or Firm* — Andrew Wilford

(57) ABSTRACT

A generally U-section adapter profile extending along a longitudinal axis forms a longitudinally extending and transversely open cavity and has an outer surface formed with an array of at least three longitudinally extending and radially outwardly directed outer mounting formations radially spaced from the longitudinal axis and angularly spaced around the longitudinal axis. An elongated light emitter is provided in the cavity. A generally U-section mounting rail extending parallel to the axis opens radially toward the axis and has two side walls formed with inwardly directed and longitudinally extending inner mounting formations generally complementary to the outer formations and spaced so that the profile can be fitted to the rail in at least two different positions in each of which the two inner formations of the rail engage in two of the outer formations of the profile.

20 Claims, 2 Drawing Sheets

MOUNTING RAIL FOR A LAMP

FIELD OF THE INVENTION

The present invention relates to ceiling- or wall-mount lamp. More particularly this invention concerns a mounting rail and adapter assembly of such a lamp.

BACKGROUND OF THE INVENTION

Light fixtures, in particular light-emitting-diode (LED) strips with a mounting face for light fixtures located inside the adapter profile that is located between two spaced and confronting walls and diametrically opposed to an opening of the adapter profile.

Adapter profiles of for use in light fixtures are known in prior art. In a simple case, such an adapter profile can, for example, be a longitudinally extending extruded profile of U-section. Thereby the inner surface of the base of such a profile forms a mounting face for the illuminant or light emitter that extends between two side walls or brackets extending from the base.

For example, this type of adapter profile is in combination with LED strips in which a number of individual LEDs are lined up next to each other on a fixed or flexible printed-circuit board. The board can offer mechanical protection for the light fixture, just like cooling bodies, in particular when used in combination with LED light emitters or strips.

In adapter profiles known in prior art it is felt to be disadvantageous that they essentially have only one mounting position in which the adapter profile can be fastened, for example, on a wall or on a ceiling. This single mounting position is one in which, as a rule, the mounting face of the light emitter extends parallel to a wall or ceiling on which the adapter profile is fastened. The radiation property of a lamp that is formed by such an adapter profile is thus, relative to the wall or ceiling section at which the lamp is fastened, definitely specified and is essentially defined by the radiation angle of the light emitters located in the adapter profile relative to the mounting face and thereby simultaneously relative to the wall or ceiling that is parallel to it, at which the adapter profile is fastened.

OBJECTS OF THE INVENTION

It is therefore an object of the present invention to provide an improved lamp assembly.

Another object is the provision of such an improved lamp assembly that overcomes the above-given disadvantages, in particular whose adapter profile of the generic type cited above in such a way, that this adapter profile can be used by itself, but in particular in combination with a mounting rail according to the invention to offer the possibility of flexible mounting and thus the possibility of different orientations of the radiated light relative to a wall or ceiling or another structural application of the lamp including an adapter profile according to the invention and/or a mounting rail.

SUMMARY OF THE INVENTION

A generally U-section adapter profile extending along a longitudinal axis forms a longitudinally extending and transversely open cavity and has an outer surface formed with an array of at least three longitudinally extending and radially outwardly directed outer mounting formations radially spaced from the longitudinal axis and angularly spaced around the longitudinal axis. An elongated light emitter is provided in the cavity. A generally U-section mounting rail extending parallel to the axis opens radially toward the axis and has two side walls formed with inwardly directed and longitudinally extending inner mounting formations generally complementary to the outer formations and spaced so that the profile can be fitted to the rail in at least two different positions in each of which the two inner formations of the rail engage in two of the outer formations of the profile.

Thus, it is an important core concept of the invention that the adapter profile according to the invention extends longitudinally parallel to an axis around which the adapter profile can be rotated so that the adapter profile can be fastened to a mounting rail in at least two, preferable even more different and discrete angular positions that are angularly offset around this axis.

Accordingly, for example, a mounting rail working together with the adapter profile is secured to a wall or ceiling or at another support so that the mounting rail is fixed. According to the invention the adapter profile can be secured to this thus fastened mounting rail in at least two different angularly offset positions. For this reason a user can vary the direction of radiation of the light from a light emitter in the adapter profile, at least within the various different, in particular discrete angularly offset positions around the longitudinal axis.

Hereby, it is found to be advantageous that the mounting formations or mounting formations of the adapter that work together with the corresponding snap means or mounting formations of the mounting rail, extend longitudinally parallel to the longitudinal axis of the adapter profile, so that at least within the length of the mounting formations parallel to the longitudinal axis, an axially variable fastening possibility is given parallel to the longitudinal axis. Furthermore, the interlocked mounting formations make an axial variability of position, in particular even displacement of the adapter profile within the mounting rail possible, due to the longitudinal extension of at least the mounting formations of the adapter profile.

As a result, it is especially advantageous when in a refinement according to the invention, the mounting formations extend over the entire length of the adapter profile, so that it is possible to mount the adapter profile at any axial position along to its longitudinal axis to the mounting rail, or its mounting formations.

The advantageous result is that an adapter profile according to the invention can be produced as an extruded profile, for example, from a light metal such as aluminum, having the same cross section over its entire length.

In a furthermore advantageous design of the adapter profile that the axis around which the adapter profile can be rotated and fixed in at least two discrete angularly offset positions at the mounting rail is located inside of the adapter profile between the mounting face and the opening. Rotating the adapter profile relative to the mounting rail (subsequent to prior unlocking) has the effect that only the direction of radiation of the light of the light emitter located in an adapter profile changes, without having to reposition the adapter profile itself in the room or reconnect its power supply. The adapter profile remains essentially fixed in the room and is only rotated around the cited axis and can be locked with the mounting rail in a different position of rotation.

A structurally preferred design is that the adapter profile has flat faces between the mounting formations. These faces can, for example, be oriented in such a way that they form, seen axially, a concave polygon where the corners of the polygon lines are the adapter mounting formations.

Accordingly, the corners of this polygonal line are not to be understood as corners in the mathematical sense, but as regions in which the previously cited faces that represent polygonal lines in cross section merge into each other. This transition is not formed as an angle in the mathematical sense, in which the lines or faces meet each other, but as the mounting formation with which a mounting formation of the mounting rail can fit, preferably snapped in place. To this end the formations on one side are outwardly concave and the formations on the other side are outwardly complementarily convex, but dimensioned so that they can, with limited elastic deformation of the adapter and/or of the rail, be snapped together and hold.

A particularly preferred design of the mounting formations of the adapter profile is that the mounting formations on one side are grooves that extends axially of the adapter profile, whereby in a particularly advantageous design, such a groove has, at least in sections, a partly circular, in particular at least in sections, semicircular cross section. Precisely the design as an at least partly of circular or semicircular cross section offers the advantage here that mounting formation which on rotation of the adapter profile around the axis can fit with a corresponding mounting formation, always has a correct alignment, as the thus formed mounting formation is symmetrical relative to its axis parallel to the center axis of the adapter, at least in a certain angular range (for example, 180°).

As a result, it is furthermore advantageous that the center of the circle on which lie the at least part-circular cross section areas of each groove is at the longitudinal axis and that each of these mounting formations has an equal radial spacing from this axis. As a result on rotation of the adapter profile around the axis of rotation and fixation of the adapter profile on at least one, preferably simultaneously at several mounting formations, the axis of rotation remains fixed or at least in turn always reassumes the same position in the mounting rail after fixation on the mounting rail.

In principle, according to the invention, only a single one of the mounting formations, in particular one which extends over the entire length of the adapter profile, can be used to fix the adapter profile on the mounting rail.

A particularly safe and rigid mechanical connection between an adapter profile and a mounting rail is, however, seen therein in a preferred design, when a fixation takes place between adapter profile and mounting rail by at least two of the in total several available mounting formations of the adapter profile. Accordingly, an adapter profile can have a number of at least three mounting formations, whereby it is provided that a respectively associated pair of two mounting formations of the adapter profile always works together with two corresponding mounting formations of a mounting rail to establish the fastening of the adapter profile at the mounting rail.

Furthermore according to the invention two directly adjacent mounting formations in the circumferential direction of the cross section perpendicular to the longitudinal axis of the adapter profile form such a mounting formation pair.

However, in a preferred design of the adapter profile it can also be provided that a first mounting formation of all mounting formations together with the second mounting formation, which has a larger spacing to the first mounting formation in the circumferential direction than that which is the next one in circumferential direction, preferably the next to next mounting formation in the circumferential direction, forms a mounting formation pair, by which the adapter profile can be fixated at a mounting rail. Thus when two of the mounting formations on the adapter are gripped by the two mounting formations of the rail, one of the other mounting formations of the adapter lies between the two that are in use. As a result the spacing between the two mounting formations that are used at any time can be very large, which in turn imparts considerable rigidity to the adapter profile, in particular after fastening at the mounting rail.

In a furthermore preferred design, the cavity formed by the interior of the adapter profile flares outward from the mounting face in the direction of the opening of the adapter. This ensures for example that the diverging light beam from a light emitter on the mounting face is not blocked by these confronting walls of the adapter profile. At the same time they give the light assembly a stable but smaller structure. Thus, for example, the inner faces of the side walls can be inclined toward each other in such a way that the spacing between these inner faces increases away from the mounting face toward the opening.

Here, it can be provided, moreover, that the side walls, in particular respectively those close to the mounting face, have a groove extending in the longitudinal direction, in particular, an undercut grooves that, for example, can have a part-circular cross section at least in sections. The two grooves of the side walls can be open here in the direction toward each other.

These undercut grooves, in particular when they have at least in sections a part-circular cross section, can be used for example for anchoring screws axially of the adapter profile and to thus, for example, screw end caps onto an adapter profile. The grooves can moreover take over alternatively or cumulatively to the previously cited functions also the function that a potting compound, which is poured into the interior of the adapter profile flows into this groove, so that deformation of the hardened potting compound out of the adapter profile is safely prevented even when the interior of the adapter profile expands from the mounting face in the direction of the opening.

In particular, to facilitate the positioning and fixation of LED strips on the mounting face inside such an adapter profile it can additionally be provided that two parallel spaced grooves are provided in the mounting face that extend in the longitudinal direction of the adapter profile, between which at least one light emitter, in particular an LED strip can be positioned. Such a groove can thus form a visual guide within the meaning of a shadow gap to facilitate the installation and positioning of the light emitter, in particular an LED strip on a circuit board, for assembly personnel.

In an alternative design, instead of two spaced grooves, two spaced ridges projecting from the mounting face can be provided to an LED strip between these walls.

The previously cited side walls of the adapter profile can each have a projecting ridge directed toward the interior of the adapter profile at their respective outer ends close to the opening. The projecting ridge of each wall can extend in turn over the entire length of an adapter profile, so that even with such a projecting ridge, the design as extruded profile is possible.

The projecting ridges of the side walls accordingly are directed toward each other and can, for example, be provided for fastening a cover element or lens in the opening section of the adapter profile by clamping. Beyond that, the projecting ridges can also be an auxiliary element when filling the interior with a potting material to show the maximum fill level of the potting material. Thus the projecting ridges pointing to each other show that the potting material, starting with reaching the fill level—which corresponds to the level of the projecting ridges with respect to the mounting face—first forms a slight camber at this projecting ridge because of the tapered cross section of the opening. This potting material can be an at least translucent and preferably transparent material, typically of plastic.

To the extent fixation of an adapter profile is not exclusively provided by a mounting rail described in the following, in a further development the adapter profile on the exterior of at least one of the faces between two mounting formations, in particular, in a face parallel to the mounting face of the at least one light emitter, has an outwardly open groove, especially preferred, an undercut groove.

Such a groove can be provided here, for example, for locating a power cable in it, whereby contact with a power cable and a light emitter located in the interior can be established through at least one passage that extends between the groove base and the mounting face. In addition to the use of such a groove as cable guide or housing, it can also be used for positioning a slide block that has a cable fastened in it and to, for example, position an adapter profile hanging overhead on a rope, using the adapter to make the light assembly into a pendant fixture.

Even here, it can, if necessary be provided to have such an undercut groove, not only at one of the faces between two mounting formations, but in or at several of the previously cited faces. In such a case there is also the possibility in the case of a hanging mounting of an adapter profile, depending on the selection of the corresponding groove, to change the direction of radiation from the lamp that is realized with such an adapter profile.

In customary installation a mounting rail for fastening can be used to support an adapter profile of the type described previously, which has two parallel brackets at a spacing to each other, in particular at least substantially parallel, that are connected with each other, for example, in a base section, so that a mounting rail of this type can essentially have a U-section, and the respective upper ends of the brackets are formed as mounting formations working together with a respective mounting formation of the adapter profile.

Here too, such respective mounting formations extend in the longitudinal direction of the mounting rail, particularly preferred over the entire length of the mounting rail, which can then likewise be produced as extruded profile, for example, from light metal such as aluminum.

Thus, such a mounting rail has two mounting formations at a spacing extending in longitudinal direction and perpendicular to this direction of extension, which can be snapped together with a pair of mounting formations on the adapter profile, in order to releasably lock together the adapter profile and mounting rail.

Preferably provided hereby, that the mounting formations are directed perpendicular to the direction of extension, as a projecting ridge that is at least in semicircular, in particular when the mounting formation of the adapter profile is a groove with essentially corresponding part-circular or semicircular cross section, as has been described is above.

These projecting ridges of the mounting rail are inclined toward each other, as a result of which a clamping effect between the adapter and rail mounting formations is ensured. In particular, a preferred design corresponding to the preferred embodiment of the adapter profile is that the mounting formations, in particular the centers of the part-cylindrical projecting ridges of these mounting formations have a spacing toward each other that corresponds at least substantially to the spacing of the (centers of the) mounting formations of a mounting formation pair of the above-described adapter profile, if necessary, somewhat smaller. To this end, the side walls or brackets of the rail can deviate somewhat from being parallel, and be inclined toward each other, for example, each by 1°.

A further, especially visually preferred embodiment is that in the mounting rail, the brackets at their lower section that is spaced from the mounting formations and where the outer section is connected by a base each have one groove extending in the longitudinal direction that corresponds at least substantially to the cross section of a mounting formation of an adapter profile of the type described previously and thus, for example, can be designed part-circular in cross section.

Even though it can thus be provided that such a groove takes on no structural retaining function between mounting rail and adapter profile, such a groove repeats, however, for example, in the way of a shadow gap, the visual appearance of those mounting formations at the adapter profile that have not actually engaged in a locking connection with the mounting formations of the mounting rail in a fastening of an adapter profile and mounting rail, and thus remain optically identifiable as groove for the outside observer. Thus for the outside observer, the impression of a visual unit is favored between adapter profile and mounting rail.

BRIEF DESCRIPTION OF THE DRAWING

The above and other objects, features, and advantages will become more readily apparent from the following description, reference being made to the accompanying drawing in which.

DETAILED DESCRIPTION

Figure 1:
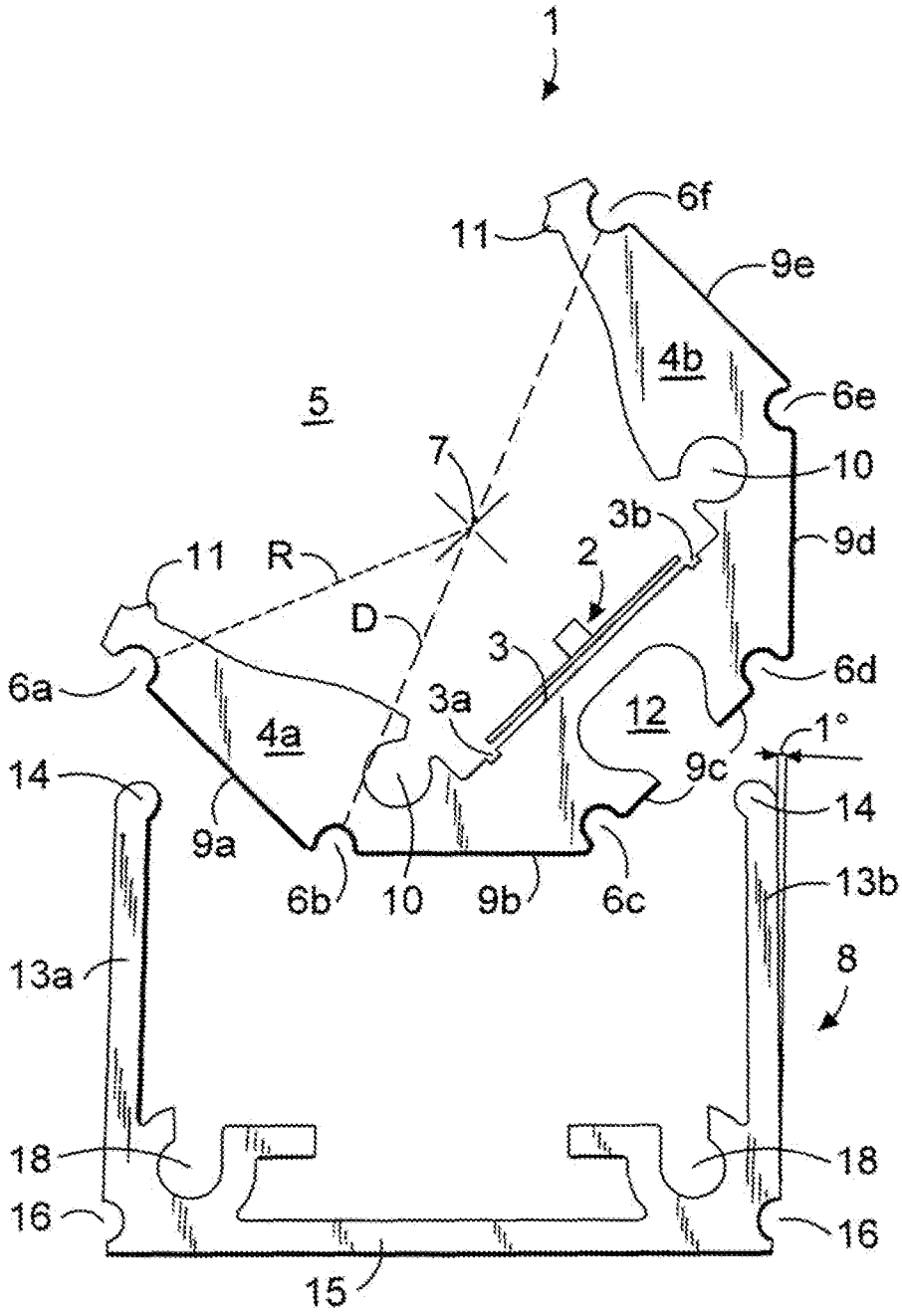
FIG. 1 is a partly diagrammatic cross section through an adapter profile and mounting rail according to the invention in unassembled condition.

FIG. 1 shows an adapter profile 1 and a profiled mounting rail 8 before they have been fitted and locked together. The adapter profile 1, which is an extruded part and basically of U-section with a polygonal outside shape, defines an internal planar mounting face 3 formed with two outwardly open parallel grooves 3*a* and 3*b* between which is mounted an LED strip 2.

The adapter profile 1, which is centered on a longitudinal axis 7 extending perpendicular to the view plane of FIG. 1, has a pair of transversely spaced and longitudinally extending brackets 4*a* and 4*b* that flank the face 3 and that have outer edges that define a longitudinally extending opening 5 open transversely away from the face 3 with the LED lamp 2.

The outer surface of this profile 1 is formed by five planar faces 9*a*-9*e* defined between semicircular outwardly open grooves 6*a*-6*f* each extending a full longitudinal length of the profile. The grooves 6*a*-6*f* are all centered on respective axes that are parallel to and at the same radial spacing R from the axis 7, and except for the wide spacing between the grooves 6*a* and 6*f* the grooves 6*a*-6*f* are angularly equispaced from each other. A chordal spacing D between grooves 6*a* and 6*d* is the same as the chordal spacing between grooves 6*c* and 6*f* and as that of grooves 6*b* and 6*e*. The faces 9*a*-9*e*, which here are planar, could also be another shape, for instance outwardly concave.

The profile is formed in the center of the face 9*c* with a longitudinally extending full-length outwardly open groove 12. In addition inwardly open circular-section full-length grooves 10 are juxtaposed with the outer grooves 6*b* and 6*e*. These grooves 10 and 12 impart some flexibility to the extruded profile 1. In addition an end cap of the profile 1 can be fixed therein. Inwardly projecting ridges 11 are formed on the inner faces of the brackets 4*a* and 4*b* at outer edges thereof. They can retain a lens having outer edges formed with complementary grooves in place, or serve to hold a mass of transparent potting in place.

The mounting rail 8 that is used with this adapter profile 1 is also essentially a U-profile in a conventional type of construction, but here has side walls or brackets 13*a* and 13*b* extending perpendicularly away from outer edges of a planar floor plate 15. The side walls or brackets 13*a* and 13*b* are transversely spaced and formed on their inner faces at their outer edges with snap formations 14, here formed as semicircular ridges with a radius of curvature identical to that of the grooves 6*a*-6*f* so that they can fit complementarily therewith. The spacing of the centers of curvature of the two snap ridges 14 is equal or very slightly less than the spacing D. The two side walls or brackets 13*a* and 13*b* are flat and have planar and parallel inner and outer faces, the latter being formed near the floor plate 165 with outwardly open semicircular grooves like the grooves 6*a*-6*f*. The side walls 13*a* and 13*b* are generally parallel, but actually converge slightly toward each other for gripping purposes as described below, here each at an angle of about 1°.

Figure 2A:
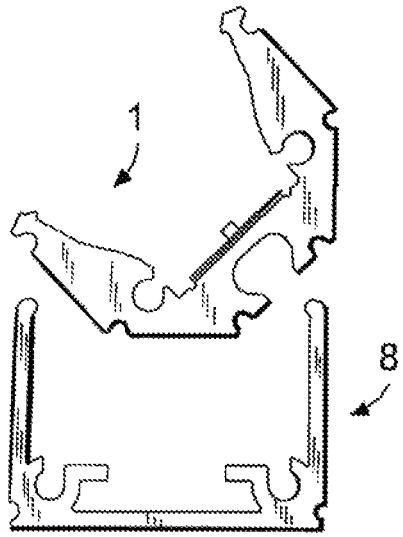
FIGS. 2A-2C are smaller-scale views of the invention in different relative orientations.
Figure 2B:
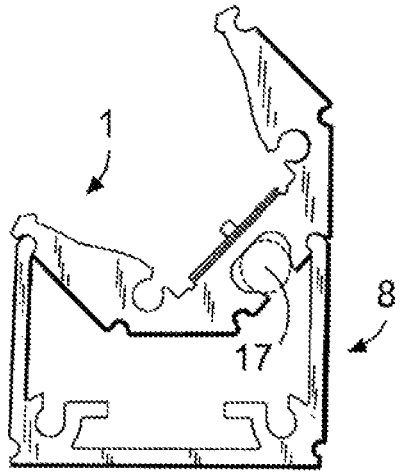
Figure 2C:
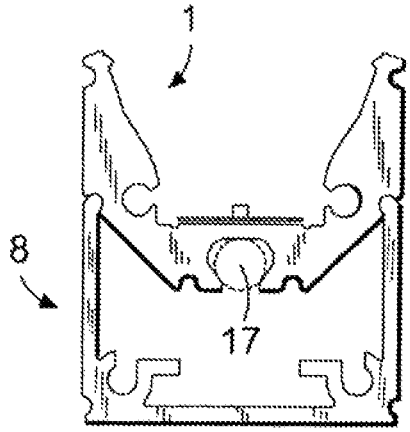

FIGS. 2A and 2B show that the mounting profile 1 can be fitted to the rail 8 by snapping the ridges 14 into the grooves 6*a* and 6*d*. In this position the brackets 13*a* and 13*b* actually grip the profile 1 and hold it solidly. Alternately the ridges 14 could engage the mounting grooves 6*c* and 6*f*. It is also possible as shown in FIG. 2C for the ridges 14 to be snapped into the grooves show that the Tt can be seen that the ridges 14 could be snapped into the grooves 6*b* and 6*e*. FIGS. 2A-2C also show that the outer groove 17 in the face 9*c* can hold a power cord 17. This groove 12 is undercut and has a mouth of a width that is somewhat narrower than a diameter of the cable 17 so that same can be pushed into the groove 12 and will be retained therein. Furthermore this undercut groove 12 can serve for mounting the adapter profile 1 directly on a ceiling by mens of a slide block fitted into its end and itself provided with an eye or nut allowing it to be hung, for instance from a cable.

Thus with the system of this invention allowing fastening between the adapter profile 1 and the mounting rail 8 at different angular positions, the position of the axis 7 remains intact, so that by a loosening, rotating and new positioning of the adapter profile 1, essentially only the angle of radiation of the light emanating from it profile is changed, not however, the actual position of this axis 7.

FIG. 1 further shows that the mounting rail 8 also has inwardly open full-length grooves 18, so that here too end caps can be fastened.

A light fixture using an adapter profile according to the invention and perhaps further a mounting rail according to the invention offers the possibility, by simple removal and reinstallation of the adapter profile in the mounting rail, of changing the direction of radiation, even if the mounting position of a mounting rail, for example, on a wall or ceiling, or also in a different mounting rail remains constant.

Accordingly, a lamp that is realized in this way has high variability with respect to other light fixtures with fixed mounting position.

We claim:

1. In combination:

a generally U-section adapter profile extending along a longitudinal axis, forming a longitudinally extending and transversely open cavity and having an outer surface formed with an array of at least three longitudinally extending and radially outwardly directed outer mounting formations radially spaced from the longitudinal axis and angularly spaced around the longitudinal axis;

an elongated light emitter in the cavity; and a generally U-section mounting rail extending parallel to the axis, open radially toward the axis, and having two side walls formed with inwardly directed and longitudinally extending inner mounting formations generally complementary to the outer formations and spaced so that the profile can be fitted to the rail in at least two different positions in each of which the two inner formations of the rail engage in two of the outer formations of the profile.

2. The combination defined in claim 1 wherein the adapter profile has an inner mounting face on which the light emitter is mounted.

3. The combination defined in claim 2 wherein the light emitter is a LED strip.

4. The combination defined in claim 3 wherein the mounting face is formed with a pair of longitudinally extending guide grooves that transversely flank the LED strip.

5. The combination defined in claim 2 wherein the mounting face is substantially planar and parallel to the axis and the emitter is directed diametrally of the axis out of the cavity.

6. The combination defined in claim 2 wherein the adapter has a pair of inner faces symmetrically flanking the mounting face.

7. The combination defined in claim 6 wherein the inner faces diverge away from the mounting face.

8. The combination defined in claim 7 wherein each of the inner faces is formed adjacent the mounting face with a respective inwardly open groove.

9. The combination defined in claim 1, further comprising a mass of at least translucent material filling the cavity.

10. The combination defined in claim 1 wherein the outer mounting formations are radially equispaced from the axis.

11. The combination defined in claim 10 wherein there at least two pairs of the outer formations and the formations of the pairs are at the same transverse spacing from each other, the inner formations being at a transverse spacing equal to or slightly less than the transverse spacing of the pairs, whereby in each of the position the outer formations of a respective one of the pairs are engaged with the inner formations.

12. The combination defined in claim 11 wherein there are three such pairs of the outer formations.

13. The combination defined in claim 1 wherein the outer formations are grooves of part-circular section and the inner formations are complementary ridges of part-circular section.

14. The combination defined in claim 1 wherein the adapter is of constant cross section.

15. The combination defined in claim 1 wherein the adapter outer surface is formed by flat outwardly directed faces extending between the outer formations.

16. The combination defined in claim 15 wherein the faces are planar.

17. The combination defined in claim 15 wherein one of the faces underlies the light emitter and is centrally formed with an outwardly open groove, the combination further comprising:

an electric supply cable extending in the groove.

18. The combination defined in claim 15 wherein the groove has a mouth of a width slightly smaller than a diameter of the cable.

19. The combination defined in claim 1 wherein the mounting rail has a pair of side walls having inner faces and outer edges and each formed on the respective inner face at the respective outer edge with the respective inner mounting formation.

20. The combination defined in claim 19 wherein the side walls converge toward each other at an angle of about 2°.

* * * * *